US008192799B2

(12) United States Patent
Kay et al.

(10) Patent No.: US 8,192,799 B2
(45) Date of Patent: Jun. 5, 2012

(54) SPRAY NOZZLE ASSEMBLY FOR GAS DYNAMIC COLD SPRAY AND METHOD OF COATING A SUBSTRATE WITH A HIGH TEMPERATURE COATING

(75) Inventors: Albert Kay, Wadsworth, OH (US); Jeganathan Karthikeyan, Akron, OH (US)

(73) Assignee: ASB Industries, Inc., Barberton, OH (US)

( * ) Notice: Subject to any disclaimer, the term of this patent is extended or adjusted under 35 U.S.C. 154(b) by 717 days.

(21) Appl. No.: 12/315,453

(22) Filed: Dec. 3, 2008

(65) Prior Publication Data

US 2010/0136242 A1 Jun. 3, 2010

(51) Int. Cl.
*B05D 1/02* (2006.01)

(52) U.S. Cl. ..... 427/427; 427/189; 427/190; 427/191; 427/192; 427/193; 427/422; 427/426

(58) Field of Classification Search ..... 427/427, 427/189–193, 422, 426
See application file for complete search history.

(56) References Cited

U.S. PATENT DOCUMENTS

| | | | | |
|---|---|---|---|---|
| 4,235,943 | A | 11/1980 | McComas et al. | |
| 6,502,767 | B2 | 1/2003 | Kay et al. | |
| 6,722,584 | B2 | 4/2004 | Kay et al. | |
| 6,736,902 | B2 | 5/2004 | Tefft et al. | |
| 6,845,929 | B2 | 1/2005 | Dolatabadi et al. | |
| 6,915,964 | B2 | 7/2005 | Tapphorn et al. | |
| 2002/0033135 | A1* | 3/2002 | Kay et al. | 118/715 |
| 2002/0102360 | A1* | 8/2002 | Subramanian et al. | 427/419.1 |
| 2002/0168466 | A1 | 11/2002 | Tapphorn et al. | |
| 2003/0233979 | A1 | 12/2003 | Tefft et al. | |
| 2004/0191449 | A1* | 9/2004 | Haynes et al. | 428/36.9 |
| 2006/0081174 | A1 | 4/2006 | Baran | |
| 2007/0243335 | A1 | 10/2007 | Belashchenko | |
| 2007/0278324 | A1* | 12/2007 | Gartner et al. | 239/132 |

FOREIGN PATENT DOCUMENTS

| | | | |
|---|---|---|---|
| WO | 2007054313 | A1 | 5/2007 |
| WO | 2007110134 | A1 | 10/2007 |
| WO | 2008031185 | A1 | 3/2008 |
| WO | 2008073110 | A1 | 6/2008 |
| WO | 2008098336 | A1 | 8/2008 |

* cited by examiner

*Primary Examiner* — Timothy Meeks
*Assistant Examiner* — Nathan T Leong
(74) *Attorney, Agent, or Firm* — Hudak, Shunk & Farine, Co. LPA

(57) ABSTRACT

The invention relates to an improved design for a spray gun and application system for cold gas dynamic spraying of a metal, alloy, polymer, or mechanical mixtures thereof. The gun includes a rear housing comprising a powder inlet and a gas inlet, a front housing removably affixed to the rear housing and comprising an mixing cavity therein for mixing of the powder and gas and an exit therefrom, a nozzle holder having a bore disposed therethrough and removably affixed to the front housing, and a polymeric nozzle positioned within the nozzle holder, an interior taper of the nozzle holder bore complementing an exterior taper of the nozzle. The nozzle having an initially converging, subsequently diverging centrally disposed bore therein adapted to receive the mixed powder and gas from the mixing chamber and the nozzle holder including a cooling jacket which is thermally coupled to the nozzle adjacent the nozzle inlet and mechanically coupled downstream of the nozzle inlet.

5 Claims, 2 Drawing Sheets

SPRAY NOZZLE ASSEMBLY FOR GAS DYNAMIC COLD SPRAY AND METHOD OF COATING A SUBSTRATE WITH A HIGH TEMPERATURE COATING

FIELD OF THE INVENTION

The spray gun unit and nozzle assembly are illustrated in FIG. 2 and have a modular structure for ease of fabrication, operation and cleaning. In a preferred embodiment, the spray gun includes at least three main components: a rear housing, a front housing 3, and a nozzle assembly 5 which includes an outer jacket 72, an inner cooling jacket 8 and the nozzle 6. Rear housing contains two inlets, one inlet for the gas entrained powder and the other for the heated gas resident in flexible insulated metal hose via gas entry port. An adjustable coupling allows control of the length of the extending portion of the gas entrained powder through powder feed tube into the mixing chamber to fine tune performance characteristics of the system. A diffuser facilitates the high speed mixing of the heated inlet gas from flexible metal hose via entry valve with the gas entrained powder from the powder feed tube in the front housing 3. The mixing of the heated gas with entrained powder occurs in mixing chamber with egress into a converging 12 and diverging 14 nozzle to impart supersonic velocities to the gas and entrained powder particles for ultimate impingement upon a substrate. The narrowed area between the converging 12 and diverging 14 areas forms a throat 13. Described similarly and alternatively, the initially converging circular bore 12 of the nozzle may be viewed as frustoconical in shape while the diverging circular bore 14 of the nozzle may be viewed as inverted frustoconical in shape, each frustoconical shape in communication with each other via restricted channel 13, and in a preferred embodiment, by co-joining of the frustoconical shapes.

BACKGROUND OF THE INVENTION

Prior art cold gas dynamic spray systems, sometimes also referred to by the term "cold spray systems", utilize a spray gun, which is in fluid-tight communication with a nozzle assembly that both directs and acts upon a supersonic gas/powder mixture which is directed at a relatively high velocity and low temperature (compared to other thermal spray processes) to impinge upon a substrate to form a coating. The gas is used as a carrier for the powder that forms a coating on the substrate, and further, as the gas is heated and subjected to temperature and pressure differentials, the carrier gas reaches a velocity that can subject the powder to a thermal and plastic deformation when it impinges upon the substrate to help cause it to adhere to the substrate. While the gas is generally below the melting temperature of the powder, it is subjected to kinetic energy to cause it to be propelled at supersonic conditions to impart sufficient kinetic energy to the powder effluent such that it will adhere to and form a continuous coating on the substrate when it impinges upon it. Given the sophisticated fluid dynamics required for this process, the interior of the nozzle has a precisely machined converging and diverging shape which subjects the powder/gas mixture to a venturi effect as it travels along the nozzle passage.

In general, an electrical heater is used to heat the large volume processing gas. The heater normally heats the gas to as high as 800° C. (1472° F.). The electric heating element, used to heat the process gas, operates under high pressure and temperature environment. During the spraying of some materials such as aluminum, the powder particles get deposited inside the nozzle on the walls blocking the gas flow path.

When the nozzle block happens, the gas flow is reduced or even stopped, causing abnormal increase in the temperature and pressure of the heating element and the gun. Such sudden increase in temperature and pressure can damage the gun and the heater, and also affect the safety of the operator.

In the past, such nozzles were made of two halves for ease of fabrication. An advance to this art is shown in U.S. Pat. Nos. 6,502,767, and 6,722,584, issued to the same inventors as the present invention As an improvement, the nozzle was made of a unitary piece of metal. In this design, the nozzle is attached to a 3-5 mm thick washer and this washer is bolted onto the gun body. Some of the issues with this design can be solved by making the nozzle out of a polymer. However, the unitary construction with a converging and diverging internal bore is expensive to manufacture, and the nozzle is typically made with a flange at the end of the nozzle where the nozzle abuts the gun. This construction provides for a relatively straightforward place to join the nozzle to the gun, but as it provides a heat sink in the area behind the diverging section of bore in the nozzle, it allows thermal energy to build there and consequently the nozzle has a tendency to foul or degrade at the higher gas temperature, required for certain coating materials. The present invention provides a nozzle assembly which utilizes a polymer nozzle with a cooling means in the area of the nozzle up stream of the diverging bore section and which has coupling section with a thermal/mechanical design.

The present invention represents a further advance for the use of ultra high temperature alloys (i.e. alloys having melting temperatures of more than about 800° C. (1472° F.). The present invention involves the use of a unitary cylindrical tapered nozzle, which is made, such as by machining, from a single block of a non-metallic material, such as polymer. The interior bore of the nozzle has a precisely shaped converging and diverging taper to induce mixing, velocity and kinetic energy of the powder and gas stream of the spray mixture. In accordance with the present invention, prior art problems with the nozzle when used with particular powders are inhibited. In the past when steel nozzles were used, the taper could become clogged, causing fouling of expensive nozzle, and resulting in down-time for the production apparatus, and possible risk of harm to the gun and heater, substrate and even possibly to workers. In contrast when polymer nozzles are used in the prior art assembly, the nozzles can be subject to thermal degradation in the area at and near the throat of the bore (i.e. where the converging and the diverging areas join). The present invention helps to solve these problems by providing a novel nozzle assembly which includes a polymer nozzle and a thermal/mechanical coupling with a cooling jacket and novel processes which include the nozzle assembly of the present invention to permit superalloys and high temperature alloys to be sprayed onto a substrate.

SUMMARY OF THE INVENTION

The invention eliminates many of the inherent limitations of the Prior Art by providing a nozzle assembly that inhibits fouling of the internal bore of the nozzle and which minimizes erosion and degradation of the nozzle at the conjunction of the nozzle and the gun exit passage, in particular at higher temperatures necessary for deposition of high temperature alloys and super alloys. This new design uses an externally tapered cylindrical polymer nozzle, a cooling jacket and a nozzle holder that abuts nozzle downstream from the abutment of the nozzle and the gun mixing chamber exit passage (i.e. downstream of the converging section of the internal passage, and where the passage begins to widen again) which allows the cooling media to be in thermal contact with the nozzle upstream of the throat of the internal bore of the nozzle. The cylindrical nozzle is held in place by a cylindrical nozzle holder with a friction fit, for example a complementary internal taper to that of the external taper of the nozzle, holding the nozzle in position and sealing the joint with an application of pressure past the convergent section of the internal taper. In light of the fact that the nozzle holder is in thermal contact with the cooling jacket, it remains cooler than the nozzle, which expands due to the hot gas passing internally therein, thereby additionally facilitating the leak-proof fit of the nozzle to the nozzle holder and of the nozzle to the gun.

It is an object of this invention to improve the fluid dynamics at the nozzle.

It is an object of this invention to improve the useful life of the nozzle, which can be quite costly. The invention further improves the operating efficiency and safety of the spray apparatus, as well as efficiency of the production of coated substrate.

It is another object of the invention to enable the use of the present apparatus for high temperature alloys and to allow a novel process of superalloy surface treatment using a cold spray process.

These and other objects of this invention will be evident when viewed in light of the drawings, detailed description, and appended claims.

BRIEF DESCRIPTION OF DRAWINGS

The invention may take physical form in certain parts and arrangements of parts, a preferred embodiment of which will be described in detail in the specification and illustrated in the accompanying drawings which form a part hereof, and wherein.

DETAILED DESCRIPTION OF THE INVENTION

Figure 1:
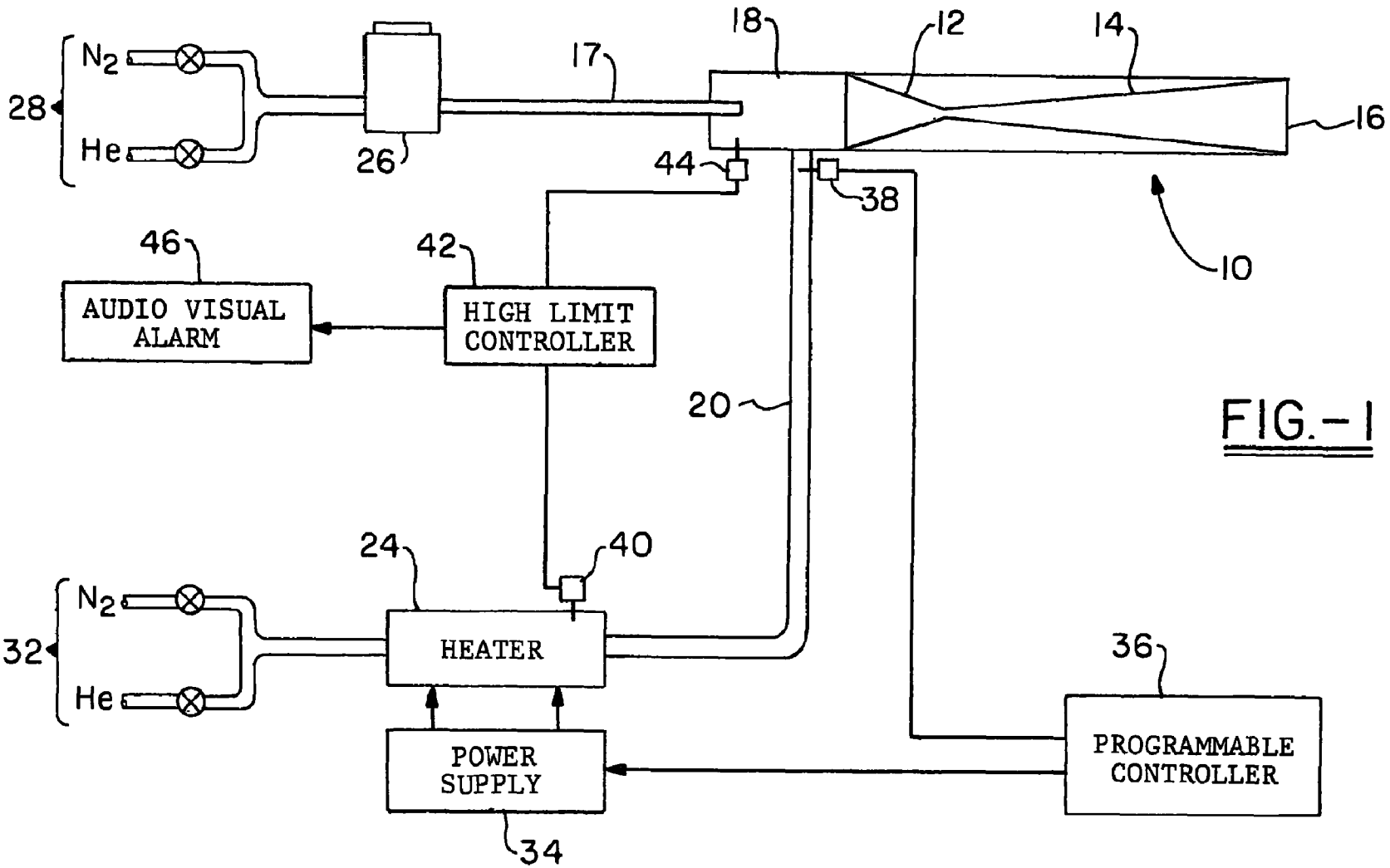
FIG. 1 is a schematic of the cold gas-dynamic spray system.

Referring now to the drawings wherein the showings are for purposes of illustrating the preferred embodiment of the invention only and not for purposes of limiting the same, the Figures show the process and apparatus used in the process to effect deposition of various materials onto a substrate.

In the process illustrated in FIG. 1, two high pressure gas streams 28, 32, which streams can either be the same or different, or even mixed streams of the two high pressure gases, are fed in a predefined ratio. This ratio is determined by a number of factors, including the rate of powder delivery, the gas and particle velocity, the diameter of the tubing, the melting characteristics of the powder. The gas stream is fed into powder hopper 26 and gas heating chamber 24. It is recognized that while two separate high pressure gas streams are shown, it is possible to configure the system to use only one source of high pressure gas with a splitter valve, not shown. In this configuration, the composition of the high pressure gases fed to the powder hopper and gas heating chamber would be the same. The gas heating chamber may be a straight pass through furnace or include a serpentine or helical path. The heating means may be by ceramic cartridge heaters, flame, heat exchanger tubes, electrical heating, or by any other known heating means. The heated gas exits the heater via exit flexible insulated metal hose 20 into the nozzle assembly 10 via gun body 18, where it combines with a predetermined quantity of powder which has been picked up from the powder hopper 26 via flexible powder hopper feed tube 17. Cold spray systems are available under the tradename Kinetiks® from ASB Industries in the USA, and from Cold Gas Technology GmbH in Germany. Suitable systems for the present invention include the Kinetiks® 4000 and Kinetiks® 2000 portable cold spray system. The invention can be supplied as an OEM feature or existing cold spray equipment can be retrofit with the nozzle holder and cooling assembly of the present invention.

Figure 2:
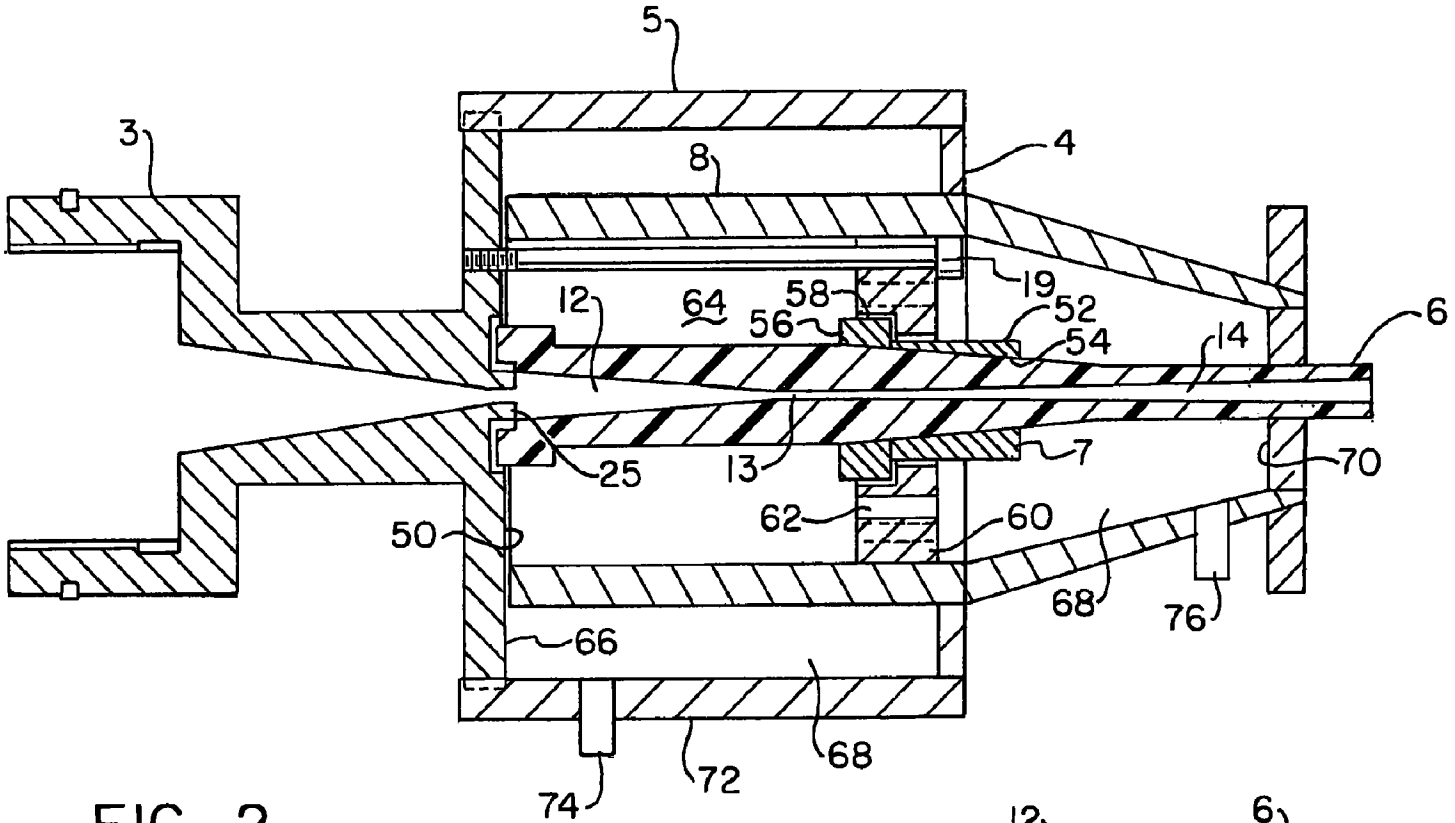
FIG. 2 is a side view, shown in partial cross-section, of a spray gun and nozzle assembly used in the practice of the invention shown in FIG. 1 and in accordance with the present invention.
Figure 3:
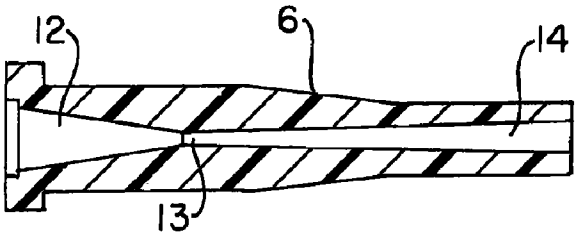
FIG. 3 is an enlarged cross-sectional view of a single-component nozzle.

The spray gun unit and nozzle assembly are illustrated in FIG. 2 and have a modular structure for ease of fabrication, operation and cleaning. In a preferred embodiment, the spray gun includes at least three main components: a rear housing 1, a front housing 3, and a nozzle assembly 5 which includes the nozzle 6. Rear housing 1 contains two inlets, one inlet for the gas entrained powder 7 and the other for the heated gas resident in flexible insulated metal hose via gas entry port 9. An adjustable coupling 8 allows control of the length of the extending portion 13 of the gas entrained powder through powder feed tube 7 into the mixing chamber 15 to fine tune performance characteristics of the system. A diffuser 2 facilitates the high speed mixing of the heated inlet gas from flexible metal hose via entry valve 9 with the gas entrained powder from the powder feed tube 7 in the front housing 3. The mixing of the heated gas with entrained powder occurs in mixing chamber 15 with egress into a converging 12 and diverging 14 nozzle to impart supersonic velocities to the gas and entrained powder particles for ultimate impingement upon a substrate. The narrowed area between the converging 12 and diverging 14 areas forms a throat 13. Described similarly and alternatively, the initially converging circular bore 12 of the nozzle may be viewed as frustoconical in shape while the diverging circular bore 14 of the nozzle may be viewed as inverted frustoconical in shape, each frustoconical shape in communication with each other via restricted channel 13, and in a preferred embodiment, by co-joining of the frustoconical shapes.

In a preferred embodiment, the nozzle holder assembly 5 includes a nozzle collar 7 which is in thermal-mechanical communication with the exterior surface of the nozzle 6 so as to hold the nozzle in fluid tight communication against the exit side 50 of the egress port of the spray gun. The collar 7 has a cylindrical portion 52 with a central bore 54 that has a shape that corresponds to the exterior shape, and preferably to the taper of the nozzle in the area in which the two pieces interface. The collar 7 further includes an annular flange 56 that mates with a corresponding annular recess 58 in the collar holder 60 or the cooling jacket/nozzle holder assembly 5. The collar holder or nozzle nut, 60 is internal to the cooling jacket/nozzle holder and includes passages 62 for the communication of a cooling media, such as nitrogen, air or gases or other fluids including water or oil, with a larger chamber 64 that surrounds an initial portion of the nozzle 6 and in particular surrounds the exterior surface of the nozzle which extends at least the length of the nozzle having the converging portion of the bore. Of course, the chamber can extend the entire length of the nozzle. The chamber 64 is defined on one end by the outside surface of the gun adapter 66 on the lateral surfaces by the interior portion of the cooling channel 68 and at an opposing end by the front wall 70 of the cooling channel 68. The front wall 70 includes a hole for the passage of the front end of the nozzle 6. The cooling channel is held in fluid communication with a cooling jacket 72 that has an inlet 74 and an outlet 76 for the provision of the cooling media. The collar 52 constrains the nozzle at a length away from the joint between the gun adapter and the nozzle ingress. Preferably, this location is past the narrow join of the converging and diverging sections of the internal passage within the nozzle 6. The collar extends less than the entire portion of the nozzle, and something like from about 0.20 to about 0.75, and preferably from about 0.25 to about 0.5 of the length of the nozzle. The nozzle holder is positioned so as to surround and support the nozzle in the area in which it is subject to larger thermal and mechanical loads as the gas/powder mixture converges and impacts the internal passage and further to allow access of the cooling media to the nozzle. This helps to dissipate and support the nozzle and to inhibit erosion and distortion from the use of the nozzle.

Diagnostic ports to measure and control gas pressure and temperature and are incorporated at the mixing chamber. High-pressure (20 to 45 bar/300-750 psi) gas (air, nitrogen, helium and their mixtures) is used as the working gas. In order to compensate for the cooling associated with the rapid expansion at the nozzle, an electric heater 24 is used to preheat the working gas to about 200-800° C. (about 400-1500° F.). A high-pressure powder hopper feeds powder material in the size range of 10-40 microns. Conventional job handling systems such as robot, x-y manipulator, lathe, etc. are used to scan the spray beam over the substrate surface to produce the coating.

The nozzle 6 and nozzle holder assembly 5 are attached to the gun body using a large dimension ring 4 with associated bolts and nuts 19, positioning of the nozzle and nozzle holder assembly being effected through at least partial mating engagement with circular lip 25 which is inserted at least partially into nozzle bore inlet. The nozzle ring not only has sufficient strength to withstand the mechanical stresses (unlike the washer of the Prior Art), but also serves, as a heat sink so that the nozzle 6 has a lower temperature than the gun body. Proper temperature differential between the gun body and the nozzle allows the thermal expansion of the gun body to grow into the nozzle seal groove and enhance the seal at gun body/nozzle interface and avoid any leakage of gas. Thus, this design enhances sealing characteristics at higher operating temperatures. Front housing 3 and rear housing are attached using a set of nuts with associated bolts which facilitates easy and quick disassembly, cleaning, and reassembly of the gun.

Rear housing contains both gas and powder inlets. It also contains ports for monitoring the pressure and temperature of the process gas. The exact position of the powder inlet can be adjusted by use of the adjustable coupling nut. A diffuser 2 not only helps in the formation of a proper jet but also ensures that the powder is injected exactly coaxially. The front housing removably couples the gas and powder inlets to the converging/diverging nozzle. It serves to form the gas jet and properly mix the powder and gas, so that the proper spray beam is produced in the nozzle.

The heater 24 consists of a high temperature heating coil embedded in an insulating container, a variable power supply 34 and a programmable temperature controller 36. A simple power supply 34 is used to energize the heating coil. A sealed thermocouple 38 is inserted into the gas stream in close proximity of the gun body to measure the temperature of the processing gas. A high limit thermocouple 40 is installed onto the heating coil very close to the outlet, so that it will measure the wall temperature of the heating coil. This thermocouple is connected to the high limit temperature input of a high limit controller 42.

A solid state pressure sensor 44 is incorporated onto the gun body. This sensor is connected to a pressure regulator, and when the gun pressure exceeds the set pressure, this sends a signal to the high pressure input of the high limit controller 42. When the high limit controller 42 receives either the pressure or the temperature signal, it immediately switches off the heating power supply 34 and gives an audiovisual alarm 46.

A high pressure release vent is incorporated onto the gun body. When the nozzle blockage occurs and the high pressure signal sets off the alarm 46, the gas inlet valve is momentarily closed, vent opened and then the gas valve opened again to cool the heating coil.

The nozzle of the present invention can be made from various materials, and in the broadest interpretation includes steel, tungsten carbide, and non-metallica materials, such as high temperature, erosion resistant polymers, including for example Celezel™ sold by BASF or Vespel™ sold by DuPont, which is a high temperature, creep resistant polyimide. It is envisioned that other polymers having suitable temperature, strength, wear and corrosion characteristics, and inertness with the particulate and carrier gas could also be used for the nozzle.

The invention also relates in particular to a process that permits the application of a high temperature, corrosion resistant material to a substrate. This material includes a "superalloy" or "high performance alloy" which is an alloy that exhibits excellent mechanical strength and creep resistance at high temperatures, good surface stability, and corrosion and oxidation resistance. Superalloys typically have an austenitic face-centered cubic crystal structure. A superalloy's base alloying element is usually nickel, cobalt, or nickel-iron. Superalloy development has relied heavily on both chemical and process innovations and has been driven primarily by the aerospace and power industries. Typical applications are in the aerospace, industrial gas turbine and marine turbine industry, e.g. for turbine blades for hot sections of jet engines. Examples of superalloys are Hastelloy, Inconel, Waspaloy, Rene alloys (e.g. Rene 41, Rene 80, Rene 95), Haynes alloys, Incoloy, MP98T, TMS alloys, and CMSX single crystal alloys.

The following examples illustrate the process of the present invention with various substrates and coating materials. The examples are meant to be illustrative and not limiting of the invention.

Example 1

In this example, a substrate comprising aluminum was coated with a 250 micron layer of cobalt chromium aluminum yttrium using a cold gas dynamic spray process including the nozzle assembly all in accordance with the present invention as follows: The substrate was a rectangular plaque measuring 12 inches by 6 inches by ⅛ inch in thickness. The plaque was prepared by cleaning with alcohol and grit blasting with alumina grit The spray apparatus was a Kinetiks© 4000 spray system modified with the nozzle assembly of the present invention. The powder hopper of the spray system was loaded with one kilogram of cobalt chromium aluminum yttrium. The process gas was nitrogen, where the temperature and pressure in the gun were 700° C. and 40 Bars respectively. The sample was fixed in a jig and the nozzle was set to spray the sample at a distance of 1 inch with a sufficient dwell to provide a uniform coating over the surface of the sample to the desired 250 micron thickness. The nozzle assembly included the cooling jacket feed from a stream of compressed nitrogen gas. The coated substrate was sectioned in representative locations, and the quality of the coating was checked using optical microscopy. The polymer nozzle was visually inspected and no signs of deterioration were observed and a pressure stream was checked through the nozzle and no obstruction was noted.

Example 2

In this example, a substrate comprising aluminum was coated with a 250 micron layer of cobalt chromium aluminum yttrium using a cold dynamic spray process without the nozzle assembly of the present invention. The nozzle was a steel nozzle. All of the other process parameters were the same. The nozzle fouled before the coating thickness was achieved, and on inspection, the cross-sectional thickness showed heterogenous domains and unsatisfactory microstructure.

Example 3

In this example, several attempts were made to spray substrate samples comprising aluminum with a 250 micron layer of cobalt chromium aluminum yttrium using a cold dynamic spray process without the nozzle assembly of the present invention. The nozzle was a polymer nozzle. All of the other process parameters were the same. In this example, the nozzle began to deteriorate by warping and distorting at the flange joining the nozzle of the spray gun, shortly after the temperature of the gun exceeded 500° C. No further samples could be run.

Example 4

In this example, a substrate comprising steel was coated with a 200 micron layer of nickel chromium aluminum yttrium using a cold gas dynamic spray process without the nozzle assembly of the present invention. The nozzle was a steel nozzle. All of the other process parameters were the same. The nozzle fouled before the coating thickness was achieved, and on inspection, the cross-sectional thickness showed unacceptable microstructure.

Example 5

Further experiments with many other materials such as Inconel 625, Inconel 718, spherical titanium, etc, showed that all these materials require the cold spray gun to operate at temperature above 500° C. and pressure above 30 bars, and that the steel nozzles always resulted in nozzle fouling during the high temperature spray operation (before the coating thickness could be achieved) while polymer nozzles got damaged due to high temperature warping and distortion. Good quality coatings of required thickness of all these and other materials were achieved using the nozzle assembly of present invention.

Therefore, what has been described in a preferred embodiment, is an apparatus which comprises multiple parts including a housing (which may itself comprise multiple subparts), an inlet for a gas entrained powder, an inlet for a gas, a mixing cavity within the housing for mixing of the powder and gas in communication with the respective inlets therefore, the cavity having an exit for egress of the combined gas/powder stream into a nozzle.

The nozzle, which is a non-metal nozzle, and preferably is a polymer, is in intimate physical contact with the housing and affixed thereto by a nozzle holder including a cooling jacket and having a tapered cylindrical bore centrally disposed therethrough and spaced apart from the outlet of the housing or gun body or adapter. The nozzle holder is removably attached to said housing with a fastening means, typically a bolt and a screw although other modes of attachment are envisioned, e.g., elimination of the bolt via an internally threaded bore which allows the present invention to be fitted to existing spray apparatuses for practice of the process in accordance with the present invention. The spray gun nozzle is preferably a unitary piece of polymer that has a centrally disposed bore therethrough.

The nozzle bore has an inlet end and an exit end and a constriction interposed between the two ends. In a preferred embodiment, the inlet end has a right frustoconical shape extending partway therethrough and in communication with an inverted right frustoconical shaped bore exit at an opposed exit end. The nozzle bore is in communication with the mixing cavity exit, and leak-proof engagement is effected by positioning of the nozzle within the bore of the nozzle holder, an interior taper of the nozzle holder (collar) bore essentially matching an exterior taper of the nozzle.

The housing for the spray apparatus typically has several subparts specifically including a cooling channel and a cooling jacket which contains a cooling media in thermal communication with the nozzle of the spray apparatus. The inlets for the entrained powder and heated gas are contained within the rear housing while the mixing cavity is within a detachable front housing, secure engagement of the front and rear housings being effected via an attachment means which may be a nut and a bolt, or alternatively an internally threaded bore for receiving mating exteriorly threaded bolt.

In order to facilitate the fastening of the housing with the nozzle, the exit of the mixing cavity has a protruding lip for insertion into an inlet end of said nozzle bore. The altitude (a measure of the height of the frustonconical section as measured between the two bases) of the inlet frustoconical bore is less than an altitude of the exit frustoconical bore.

In a preferred embodiment, the nozzle holder fastening means is a housing having at least two internal diameters, the smaller diameter including internal passages for passage of a cooling media and the larger being in fluid communication with a source of the cooling media. The nozzle holder further including a nozzle collar, which forms a thermal mechanical interface with the external surface of the nozzle, where the interface is spaced apart from the converging section of the internal passage along the longitudinal axis of the nozzle to allow cooling media to be in thermal contact with this section of the nozzle.

This invention has been described in detail with reference to specific embodiments thereof, including the respective best modes for carrying out each embodiment. It shall be understood that these illustrations are by way of example and not by way of limitation.

While in accordance with the patent statutes, the best mode and preferred embodiment have been set forth, the scope of the invention is not limited thereto, but rather by the scope of the attached claims.

What is claimed is:

1. A method for gas dynamic cold spraying a substrate with a high temperature coating comprising the steps of (a) providing a substrate (b) providing a powder which has a melting temperature of more than about of 700° C. which powder is to be applied to the substrate;

(c) providing an apparatus having a housing with an inlet for a gas and a mixing cavity disposed within the housing for mixing the powder and the gas in communication with the inlets, the cavity having an exit therefrom;

(d) providing a nozzle assembly including a nozzle holder having a nozzle collar which includes a bore centrally disposed therethrough, and said nozzle assembly further including a cooling jacket including a cooling media, and a non-metallic nozzle having an exterior surface, a central longitudinal axis and a centrally disposed bore therethrough, (i) said nozzle bore having an internal passage defining a converging section extending partway therethrough from, an inlet of the nozzle bore and a diverging section extending toward an outlet end of the nozzle bore, (ii) the nozzle bore inlet in communication with said mixing cavity exit, (iii) the nozzle collar forming a thermal mechanical interface with the exterior surface of the nozzle, where the interface is spaced apart from the converging section of the internal passage along the central longitudinal axis of the nozzle to allow the cooling media to be in thermal contact with the exterior surface of the nozzle corresponding to the converging section of the nozzle, and (e) applying said powder to said substrate from the mixing cavity through the nozzle of the nozzle assembly.

2. A method for gas dynamic spraying as set forth in claim 1 wherein the powder is a superalloy.

3. A method for gas dynamic spraying as set forth in claim 2 wherein the powder is one or more alloys of nickel chromium aluminum yttrium, cobalt chromium aluminum yttrium, iron chromium aluminum yttrium.

4. A method for gas dynamic spraying as set forth in claim 1 wherein the powder is a high temperature alloy.

5. A method for gas dynamic spraying as set forth in claim 1 wherein the powder comprises one or more of titanium, tantalum, and niobium.

* * * * *

UNITED STATES PATENT AND TRADEMARK OFFICE

CERTIFICATE OF CORRECTION

PATENT NO. : 8,192,799 B2
APPLICATION NO. : 12/315453
DATED : June 5, 2012
INVENTOR(S) : Albert Kay et al.

It is certified that error appears in the above-identified patent and that said Letters Patent is hereby corrected as shown below:

In Column 9, line 8 (Claim 1): After "from" the "," should be deleted.

Signed and Sealed this
Fourteenth Day of August, 2012

David J. Kappos

David J. Kappos
*Director of the United States Patent and Trademark Office*